United States Patent [19]

Bione

[11] 4,389,915

[45] Jun. 28, 1983

[54] MUSICAL INSTRUMENT INCLUDING ELECTRONIC SOUND REVERBERATION

[75] Inventor: Angelo A. Bione, Elmhurst, Ill.

[73] Assignee: Marmon Company, Chicago, Ill.

[21] Appl. No.: 217,911

[22] Filed: Dec. 18, 1980

[51] Int. Cl.[3] ..... G10H 1/02

[52] U.S. Cl. ..... 84/1.24; 84/DIG. 4; 84/DIG. 26; 84/1.25; 179/1 J

[58] Field of Search ..... 84/1.01, 1.24, 1.25, 84/DIG. 4, DIG. 26; 333/28 T, 29; 179/1 J

[56] References Cited

U.S. PATENT DOCUMENTS

| | | | |
|---|---|---|---|
| 4,105,864 | 8/1978 | Berkovitz | 179/1 J |
| 4,121,058 | 10/1978 | Jusko et al. | 179/1 J |
| 4,219,880 | 8/1980 | Nichols | 179/1 J |
| 4,237,343 | 12/1980 | Kurtin et al. | 179/1 J |
| 4,275,267 | 6/1981 | Kurtin et al. | 179/1 J |
| 4,303,991 | 12/1981 | Moore | 84/1.25 X |

*Primary Examiner*—J. V. Truhe
*Assistant Examiner*—Forester W. Isen
*Attorney, Agent, or Firm*—Neuman, Williams, Anderson & Olson

[57] ABSTRACT

An electronic reverberation system for use in an electronic musical instrument comprises a random access memory wherein two or more time delay channels are defined by address allocation in a controller circuit. An input analog signal is converted to digital signals by an analog-to-digital converter and the digital signals are processed by the controller into the time delay channels. The channels defined in the random access memory are of differing lengths which can be changed by switch settings. The controller sequentially retrieves stored digital data words from the random access memory channels in seriatum and couples each data word to a digital-to-analog converter. The analog output signal from the digital-to-analog converter is delayed in time by varying amounts due to the length of the channels in the random access memory. A portion of the delayed analog output signal contained in each channel is mixed with the input analog signal to produce a combined signal. The combined signal is converted to a digital data word which is stored back into the random access memory location from which the last digital data word was read. An enhanced reverberation effect is selectively achieved by switchably connecting a low frequency signal on the order of two hertz as an auxiliary input to be mixed with the input analog and delayed analog signals.

6 Claims, 2 Drawing Figures

MUSICAL INSTRUMENT INCLUDING ELECTRONIC SOUND REVERBERATION

BACKGROUND OF THE INVENTION

This invention is directed to electronic musical instruments generally and, more particularly, to an electronic musical instrument including an electronic sound reverberation system.

Sound reverberation is provided in electronic musical instruments to simulate the acoustical effects of a large auditorium or concert hall in a much smaller listening area. In the concert hall or other similar large listening area, sounds reach the listener both by a direct unimpeded transmission path and by reflection from all the various surfaces within the area. These reflected signals are attenuated in varying amounts due to the nature and characteristics of the reflecting surfaces and since each reflected sound wave travels a different distance to reach the listener each is delayed a different amount of time. All of these acoustic signals, both direct and reflected, blend together for a full, pleasing sound for listeners.

Artifical sound reverberation was initially provided via mechanical spring reverberators. These mechanical reverberators generally consist of pairs of springs with slightly different time delays. The reverberator springs are driven at one end by an electrical to mechanical transducer and the delayed mechanical motions are received by a mechanical to electrical transducer at the other end which converts the mechanical movement back into signals representative of the original sounds but delayed in time. Mechanical sound reverberators suffer from numerous problems. They are easily effected by external mechanical vibration which produce spurious wounds, the quality of reproduction and delay times are effected by ambient conditions, the frequency range is generally limited to the lower frequencies of audible sound and the delay time is fixed rendering the reverberated sound repetitive and unnatural.

Various techniques have been developed for use with mechanical reverberators to attempt to overcome these problems. These techniques include the use of multiple delay lines, filtering and frequency shifting, the latter to attempt to improve the frequency response of the mechanical reverberators. While these modifications have extended the versatility of mechanical reverberators, they require either additional mechanical elements which increase the size, weight and assembly time of the mechanical reverberators or additional circuitry which is often times complicated and expensive. Furthermore, such modifications of mechanical reverberators have not completely solved the problems associated with mechanical sound reverberation.

More recently all electronic reverberators have been introduced. Electronic sound reverberation units include electric charge transferring devices which are used to set delay times to produce sound reverberation similar to the mechanical reverberation units. Digital techniques have also been employed wherein an analog signal is converted to a digital signal, passed through digital delay lines or shift registers and reconverted to an analog signal to provide the delayed time periods required for sound reverberation. None of the presently available sound reverberators provide a true and natural reverberated sound composed from the colorations and intermingling of sounds which are produced by sound waves reflecting from various surfaces at varying distances from the sound stage in a large auditorium or concert hall.

SUMMARY OF THE INVENTION

The present invention is an all electronic reverberation system for use in an electronic musical instrument which overcomes the disadvantages of prior mechanical and electronic sound reverberators and provides a true and natural reverberated sound. An analog input signal is converted to digital signals by an analog-to-digital converter. The digital signals are processed by a controller into two or more channels defined in a random access memory (RAM). Each of the channels defined in the RAM is a different length. The controller sequentially retrieves stored digital data words from the random access memory channels in seriatim and couples each data word to a digital-to-analog converter. The digital-to-analog converter produces an analog output signal equivalent to the analog input signal but delayed by periods of time which depend upon the lengths of the channels in the random access memory. A portion of the delayed analog output signal contained in each channel is mixed with the input analog signal to produce a combined original analog and delayed analog input signal for the analog-to-digital converter. The data word produced from the combined analog input signal by the analog-to-digital converter is stored back into the random access memory location from which the last digital data word was read.

This sequence of operations is performed on each of the channels in order progressing through each memory location in the random access memory. The addresses of each of the channels are looped back on themselves so that the first address of a channel is the next sequential address after the last address of the channel. This arrangement provides two or more delay channels having different delay times with each channel being independently added to the incoming music signal and delayed by the delay period for that particular channel. The output of the digital-to-analog converter is filtered to effectively combine and integrate the individual channel analog signals to produce a reverberation output signal.

The illustrative embodiment comprises three channels to provide three differing delay times. Alternate numbers of channels can be provided in accordance with this invention to create differing effects. Differing effects can also be provided by changing the memory locations which define the individual channels. Such changes in channel definitions alter the delay times for the channels.

An enhanced reverberation effect is selectively achieved in accordance with the present invention by switchably connecting a low frequency signal on the order of 2 hertz as an auxillary input to be mixed with the input analog and delayed analog signals.

BRIEF DESCRIPTION OF THE DRAWING

For a more complete understanding of this invention, reference should now be made to the illustrative embodiment which is described in greater detail in the accompanying drawing figures and described below by way of example of the invention. In the drawing.

It should be understood that the invention is not limited to the particular embodiment illustrated herein.

DETAILED DESCRIPTION OF THE ILLUSTRATIVE EMBODIMENT

Figure 1:
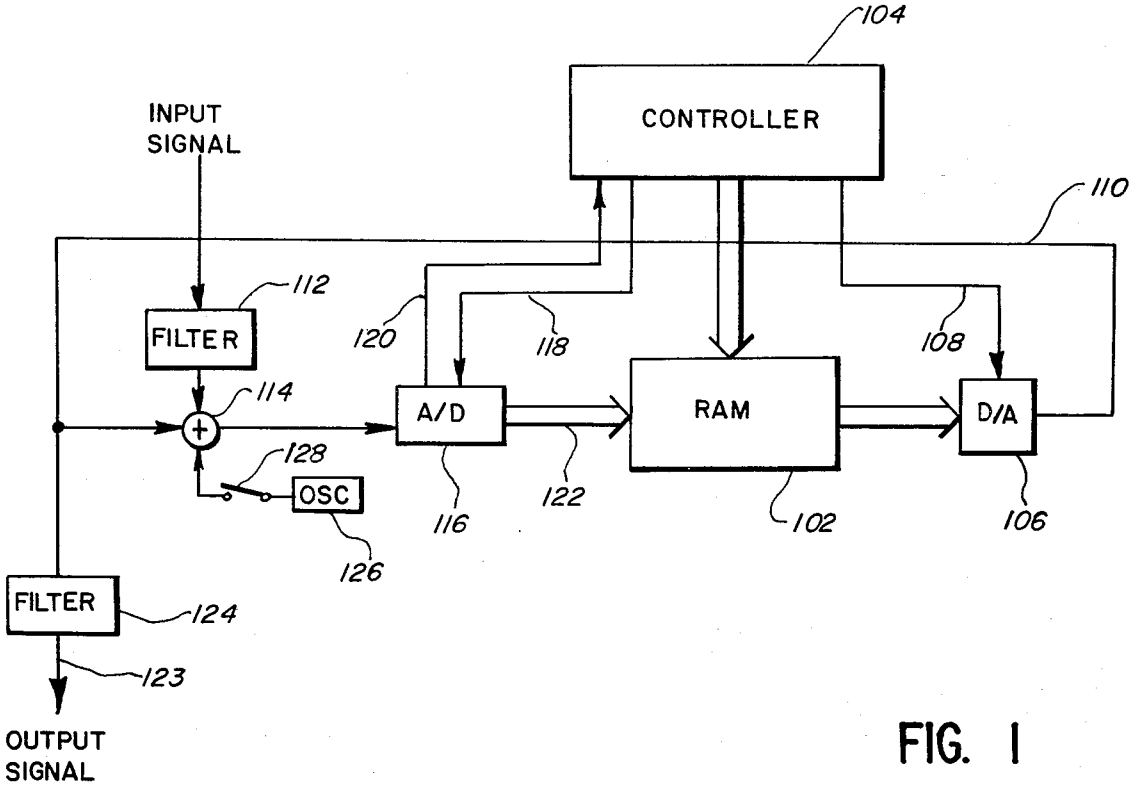
FIG. 1 is a block diagram of the electronic reverberation system for a musical instrument in accordance with the present invention.

FIG. 1 is a block diagram of a reverberation system according to the present invention for use in an electrical musical instrument. The random access memory (RAM) 102 is operated by the controller 104. The controller 104 defines a plurality of delay channels through the random access memory 102. The controller circuit 104 initially reads a memory location of the random access memory 102 and passes the digital data word to the digital-to-analog (D to A) converter 106 where it is latched into an input latch circuit via a control signal on the conductor 108. It will be assumed initially that all memory locations of the random access memory 102 are empty such that data words read from the random access memory 102 generate no analog output signal at the output of the digital-to-analog converter 106 on the conductor 110.

An analog input signal typically from an electronic musical instrument which is to be reverberated, is coupled to a low pass filter 112. The cutoff frequency of the filter for a normal audio application is selected at four kilohertz or six kilohertz, for example. The output of the low pass filter 112 is fed to a mixer 114 wherein the analog input signal is mixed with a portion of the feedback signal on the conductor 110 to be described below. Since the random access memory 102 is initially empty, no feedback signal is present on the conductor 110 until at least a portion of the random access memory 102 has been written. The analog signal from the mixer 114 is passed to the analog-to-digital (A to D) converter 116 which, in the preferred embodiment, generates a 12 bit digital representation or data word from the analog signal. An improved signal-to-noise ratio may be obtained by increasing the number of bits in the digital representation produced by the A to D converter 116 to 16 or 20 bits. The analog-to-digital converter 116 receives a start signal on the conductor 118 from the controller 104. A conversion complete signal is generated on the conductor 120 when the conversion is complete and a digital data word representative of the analog input signal is present on the conductors 122. The conductors 122 are connected as an input to the random access memory 102. The A to D and D to A converters used in the preferred embodiment of the invention are standard, commercially available integrated circuits; however, construction of comparable converters from separate components is possible and the structure of such converters is well known to those skilled in the art.

Since it has been assumed that the random access memory is initially empty, no signal is present on the conductor 110 until the shortest channel defined in the random access memory 102 has been filled.

As the analog input signal comes in through the filter 112 to the mixer 114 (since there is no signal on the conductor 110) the input signal is passed to the A to D converter 116 where it is converted to a digital signal and stored into the random access memory 102. The channels in the random access memory 102 are filled sequentially with one memory location from channel 1 being filled, followed by one memory location from channel 2 being filled, followed by one memory location from channel 3 being filled, etc. This filling or memory writing operation is continued until channel 1 is filled, channel 1 being the shortest channel. On the first channel 1 operation after all memory locations defining channel 1 have been written, the data word stored in the first storage location defining channel 1 is read and passed to the digital-to-analog converter 106. A feedback signal is generated on the conductor 110 in response to the data word. The feedback signal is combined with the analog input signal by the mixer 114 and passed to the A to D converter 116 which converts the combined signal to a digital signal which is stored back into the first storage location defining channel 1. The next memory location defining channel 2 is then loaded followed by the loading of the next memory location defining channel 3.

Eventually, all memory locations defining channel 2 have been written. On the next channel 2 operation, the data word stored in the first storage location defining channel 2 is read and passed to the digital-to-analog converter 106. A feedback signal is generated on the conductor 110 and combined with the analog input signal. The combined analog signal is converted to a digital data word and written back into the first storage location defining channel 2.

Finally, all channel 3 memory locations are filled. On the next channel 3 operation, the data word stored in the first storage location defining channel 3 is read and passed to the digital-to-analog converter 106. A feedback signal is generated on conductor 110 when the first channel 3 memory location is read and the feedback signal is combined with the analog input signal by the mixer 114. The combined analog signal is converted to a digital data word and stored back into the first storage location defining channel 3.

It should be clear that there is no correlation between the memory location defining channel 1, the memory location defining channel 2 and the memory location defining channel 3 that are written during a specific update sequence of the random access memory 102. This noncorrelation is due to the fact that the channels are of different lengths. Once the random access memory 102 has been initially filled, reverberation signals are provided on the output conductor 123 by repetitive operations on the random access memory 102 in accordance with the above description. The reverberation signals on the conductor 123 are passed through the filter 124 to combine and integrate the signals from the individual channels and to eliminate any switching noise that is created by the analog-to-digital-to-analog processing. The upper frequency limit of the filter 124 should be approximately the same as that of the input filter 112. The portion of the analog signal generated by the digital-to-analog converter 106 which is combined with the analog input signal by the mixer 114 may be set to obtain a desirable level of reverberation within the constraints of regeneration.

Figure 2:
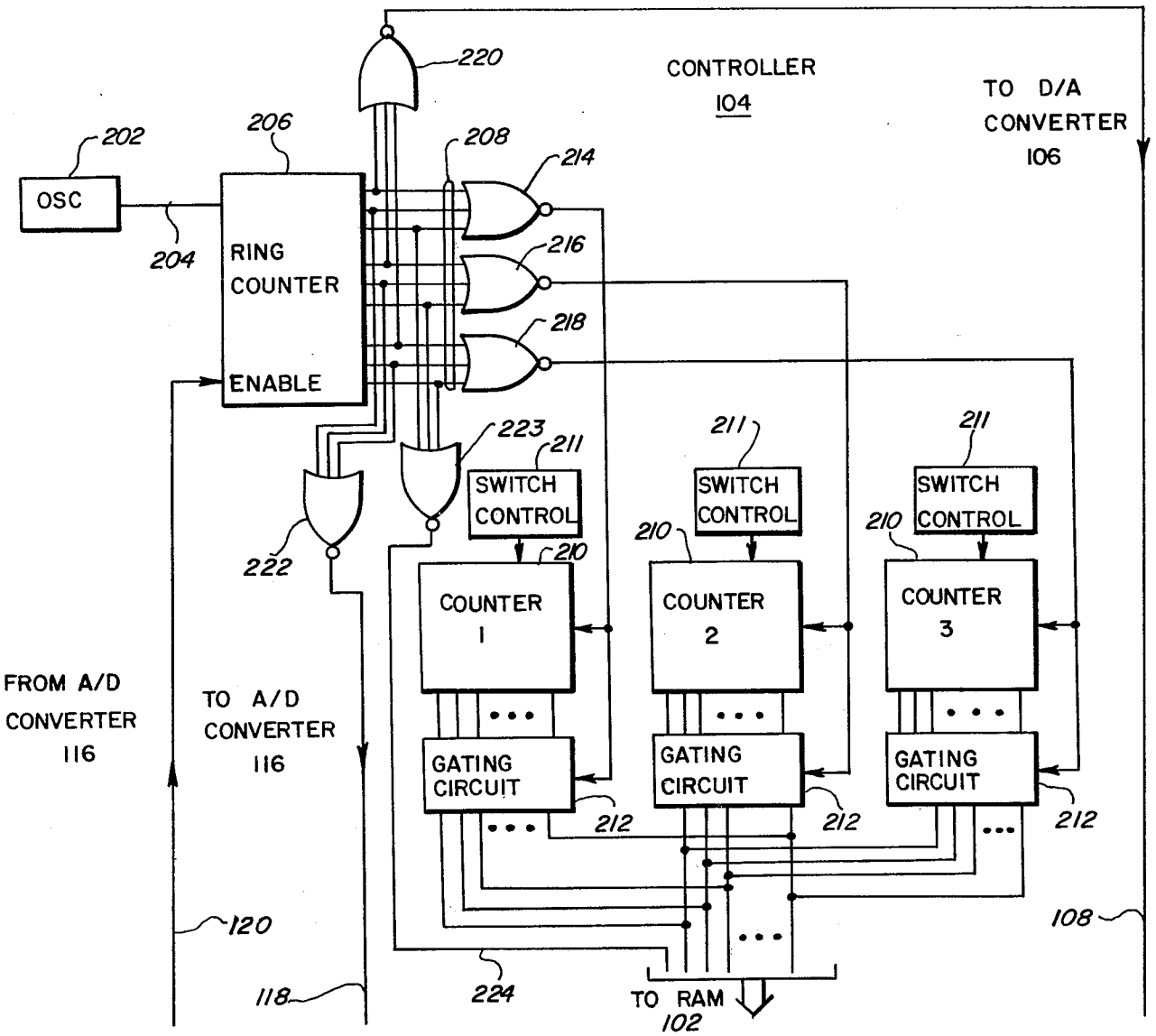
FIG. 2 is a schematic diagram of the controller of FIG. 1.

With reference to FIG. 2, an illustrative embodiment of the controller circuit 104 of FIG. 1 is shown. An oscillator 202 generates a repetitive output signal on the conductor 204 to drive the ring counter 206. The ring counter 206 sequentially generates an output signal on the nine output conductors 208, i.e., first one is active, then two, then three, etc. and the sequence is continuously repeated.

The counter circuits 210 indicated as counter 1, counter 2 and counter 3 generate the address signals which define channels 1, 2 and 3, respectively, in the random access memory 102. In the illustrative embodiment, counter 1 generates address signals corresponding to 0 through 463; counter 2 generates output signals corresponding to 464 through 1,119; and counter 3 generates output signals corresponding to 1,120 through 2,047. These address signals accordingly address all memory locations of the 2,048 location random access memory 102. The switch control units 211 associated with each of the counters 210 can be switched to adjust the memory address signals which define the individual channels. Such channel changes set different delays for the channels to create varying effects for the reverberation unit. The switch control of the counters is well known in the art and will not be further described herein.

There are three time slots associated with the operation of each of the individual channels of the random access memory 102. During the time that a channel is active, its corresponding counter circuit 210 is gated to the address input leads of the random access memory 102 via the corresponding gating circuit 212. The gating circuits 212 and the counter circuits 210 are controlled via control gates 214, 216 and 218 to address channel 1, channel 2 and channel 3 which correspond to defined storage locations in the random access memory 102.

During the first three time slots generated by the ring counter 206, signals are present on the first three of the output conductors 204 which drive the control gate 214. The control gate 214 activates the corresponding gating circuit 212 to provide the proper address signals to the random access memory 102 during these three time slots for operation on memory locations defining channel 1. Signals on the second three of the output conductors 208 drive the control gate 216 to provide address signals from counter 2 to the random access memory 102 for operation on memory locations defining channel 2 and signals on the last three leads of the output conductors 208 drive the control gate 218 to provide address signals from counter 3 to the random access memory 102 for operation on memory locations defining channel 3.

During time slot 1, the contents of the addressed memory location of the random access memory 102 is read out to the digital-to-analog converter 106. The control gate 220 which is activated by a signal on any one of the time slot 1 conductors of the conductor group 208, unlocks latch circuits which form the input of the digital-to-analog converter 106. During time slot 1, the output data word read from the random access memory 102 stabilizes and propagates into the latch circuits of the digital-to-analog converter 106. The passing of time slot 1 locks the data word read from the random access memory 102 into the latch circuits.

During time slot 2, control gate 222 provides a start signal to the analog-to-digital converter 116 via the conductor 118. By this time, the output of the digital-to-analog converter 106 is stable on the conductor 110 and has been combined with the analog input signal coming into the mixer 114 and the combined signal is present on the input of the analog-to-digital converter 116. The converter 116 starts the conversion process upon receiving the start signal on conductor 118 and at that time, changes the state of the signal on the conversion complete lead 120 which normally enables the ring counter 206 to continue its sequence through the various time slots required for operation of the reverberation apparatus. Since the analog-to-digital converter 116 requires more time than is provided by time slot 2, the ring counter 206 is disabled by the signal on the conductor 120 to allow the converter to generate a digital data word on the conductors 122. Once the analog-to-digital conversion is complete, a conversion complete signal is generated on the conductor 120 which again enables the ring counter 206 to continue counting and progress to time slot 3. The conversion complete signal is generated by circuitry provided on standard commercially available integrated circuit A to D converters or may be generated by a flip-flop circuit which monitors the output of the A to D converter.

During time slot 3, a write signal is generated by the control gate 223 and is passed to the random access memory via the conductor 224. Accordingly, the digital data word generated in response to the signal from the mixer 114 is written into the storage location that was read during time slot 1. When time slot 3 terminates, the counter which has been addressing the random access memory 102 is incremented by one. The counters 210 are connected to repetitively count through the addresses of the random access memory which define the three delay channels. Time slots 1, 2 and 3 function the same for all the channels and are continuously repeated by the ring counter 206 in accordance with the sequence previously described.

With reference again to FIG. 1, the reverberation effects can be enhanced by an additional input into the mixer 114. The oscillator 126 generates a low frequency signal on the order of 2 hertz which can be selectively connected as an input into the mixer 114 via the switch 128. By the provision of the low frequency oscillator 126 and the switch 128, the enhanced mode of the reverberation unit can be selectively enabled or disabled.

From the above description, it is apparent that a reverberation unit incorporating multiple delay time periods with intermingling of the present input signal with variously delayed input signals which have been previously combined with pre-existing input signals, has been achieved to provide a more realistic reverberation output signal. While only an illustrative embodiment has been set forth, alternative embodiments and various modifications will be apparent from the above description to those skilled in the art. For example, alternative ways of producing the controller including microprocessor control are evident. Similarly, the reverberation process could be controlled entirely by software in a computer system. These and other alternatives are considered equivalents and within the spirit and scope of the present invention.

What is claimed is:

1. An electronic musical instrument having circuitry for generating a tone signal representative of a musical tone and a reverberation circuit for receiving said tone signal and producing a reverberated tone signal, said reverberation circuit comprising:

first converter means receiving an analog input and providing a digital data word output;

a random access memory receiving said digital data word output from said first converter means, providing a digital output signal and having a plurality of addressable memory locations froming at least a first channel and a second channel, each of said channels being separate and individual from said other channels and each comprising a different number of memory locations, each of said memory locations stores a digital data word output from said first converter;

second converter means receiving said digital output signal from said random access memory and providing an analog delay output;

addressing means comprising at least first and second counter circuits, said first counter circuit generating first address signals connected to said random access memory and defining said first separate and individual channel in said random access memory and said second counter circuit generating second address signals connected to said random access memory and defining said second separate and individual channel in said random access memory;

first control means having a first control output signal connected to said second converter means for transferring a data word from a predetermined memory location in said random access memory to said second converter whereby said analog delay signal output is generated by said second converter in response to said data word;

a mixer circuit for receiving said analog delay signal of said second converter and said tone signal and combining a portion of said analog delay signal of said second converter with said tone signal and providing a mixed signal as said analog input to said first converter;

second control means having a second control output signal connected to said first converter for enabling said first converter to generate said digital data word output in response to said mixed signal;

third control means having a third control output signal connected to said random access memory for transferring said digital data word generated in response to said mixed signal to said input of said random access memory and into said predetermined memory location from which the original digital data was transferred by said first control means;

Sequencer means having a plurality of sequence output signals at least one of which is connected to each of said first, second and third control means and said addressing means for providing data words from said random access memory with one individual word being transferred from each of said separate and individual channels in repeated channel sequence and with each of said individual data words being transferred from each of said separate and individual channels sequentially; and an output circuit for receiving, filtering and intergrating said analog delay signal from said second converter means and for generating said reverberated tone signal.

2. The apparatus of claim 1 wherein said sequencer means comprises:

a source of clock signals; and a ring counter circuit for repetitively generating sequence output signals in response to said clock signals, said sequence signals occur in groups of three with each group of three corresponding to one of said channels; and, said first, second and third control means being responsive to said sequence signals and each of said counter circuits of said addressing means bring responsive to selected ones of said sequence output signals to increment their respective address signals to the next memory location in the corresponding channels.

3. The apparatus of claim 1 further comprising a signal generator having a reverberation enhancement output signal which is unrelated to said tone signal, said reverberation enhancement output signal being connected with said mixer and combined with said tone signal and a portion of said analog delay signal by said mixer for enhancing said reverberated tone signal.

4. The apparatus of claim 3 wherein said enhancement signal is a low frequency sine wave signal.

5. The apparatus of claim 3 wherein said enhancement signal is about a 2 hertz sine wave signal.

6. A process for producing a reverberated tone signal in an electronic musical instrument having circuitry for generating a tone signal representative of a musical tone, comprising the steps of:

(A) defining at least first and second separate and individual channels in a digital storage device by assigning different numbers of storage locations in said storage device to said separate and individual channels;

(B) reading a digital data word at a defined storage location identified by a first channel storage location indicator in said digital storage device corresponding to the first one of said separate and individual channels;

(C) passing the stored data word to a digital-to-analog converter;

(D) generating an analog delay signal in response to said data word;

(E) passing said analog delay signal through a filter circuit to generate a reverberated tone signal;

(F) combining said analog delay signal with said tone signal to form a combined tone signal;

(G) transferring said combined tone signal to an analog-to-digital converter;

(H) generating a digital data word in response to said combined tone signal;

(I) storing said digital data word generated in response to said combined tone signal into the digital storage device at said storage location previously read;

(J) advancing said first channel storage location indicator to the storage location which corresponds to the next sequential storage location for said first one of said separate and individual channels;

(K) reading a digital data word at a defined storage location identified by a second channel storage location indicator in said digital storage device corresponding to the second one of said separate and individual channels;

(L) passing the stored data word to a digital-to-analog converter;

(M) generating an analog delay signal in response to said data word;

(N) passing said analog delay signal through a filter circuit to generate a reverberated tone signal;

(O) combining said analog delay signal with said tone signal to form a combined tone signal;

(P) transferring said combined tone signal to an analog-to-digital converter;

(Q) generating a digital data word in response to said combined tone signal;

(R) storing said digital data word generated in response to said combined tone signal into the digital storage device at said storage location previously read;

(S) advancing said second channel storage location indicator to the storage location which corresponds to the next sequential storage location for said second one of said separate and individual channels; and, (T) repetitively performing steps (B) through (S).

* * * * *